US010190754B2

(12) United States Patent
Harpenau et al.

(10) Patent No.: US 10,190,754 B2
(45) Date of Patent: Jan. 29, 2019

(54) OPTICAL ATTACHMENT FEATURES FOR LIGHT-EMITTING DIODE-BASED LIGHTING SYSTEM

(71) Applicant: Cooper Technologies Company, Houston, TX (US)

(72) Inventors: Kevin Roy Harpenau, Peachtree City, GA (US); Jyoti Kathawate, Smyrna, GA (US); James Richard Christ, Peachtree City, GA (US); Jason Q. Paulsel, Peachtree City, GA (US); Russell Bryant Green, Douglasville, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 128 days.

(21) Appl. No.: 15/463,667

(22) Filed: Mar. 20, 2017

(65) Prior Publication Data

US 2017/0191641 A1 Jul. 6, 2017

Related U.S. Application Data

(63) Continuation of application No. 13/746,835, filed on Jan. 22, 2013, now Pat. No. 9,599,315.

(Continued)

(51) Int. Cl.
*F21V 21/00* (2006.01)
*F21V 21/04* (2006.01)

(Continued)

(52) U.S. Cl.
CPC ..... *F21V 21/04* (2013.01); *F21S 8/02* (2013.01); *F21S 8/026* (2013.01); *F21V 13/04* (2013.01);

(Continued)

(58) Field of Classification Search
CPC ..... F21V 21/04–21/049; F21V 13/045; F21V 13/06; F21V 13/12; F21V 13/14;

(Continued)

(56) References Cited

U.S. PATENT DOCUMENTS 4,055,874 A 11/1977 Brown
4,332,060 A 6/1982 Sato (Continued)

FOREIGN PATENT DOCUMENTS

KR 2011-008796 1/2011

*Primary Examiner* — Sean Gramling
*Assistant Examiner* — Gerald J Sufleta, II
(74) *Attorney, Agent, or Firm* — King & Spalding LLP

(57) ABSTRACT

An optical attachment feature of a light-emitting diode (LED) lighting system includes an enclosure, a trim, a reflector, and a diffuser. The enclosure can include an enclosure wall forming a cavity and an enclosure collar having a first profile. The trim can include a trim collar that abuts to the enclosure collar, wherein the trim collar has a second profile. The reflector can include an outer surface, an inner surface having reflective material disposed thereon, and a reflector collar having a first optical attachment mechanism. The diffuser can include a diffuser collar, where the diffuser collar can include a second optical attachment mechanism and a third optical attachment mechanism, where the second optical attachment mechanism can couple to the first optical attachment mechanism, and where the third optical attachment mechanism is disposed within a feature formed by the first profile and the second profile when the enclosure collar is mechanically coupled to the trim collar.

20 Claims, 8 Drawing Sheets

Related U.S. Application Data

(60) Provisional application No. 61/588,537, filed on Jan. 19, 2012.

(51) Int. Cl.

| | |
|---|---|
| ***F21S 8/02*** | (2006.01) |
| ***F21V 17/16*** | (2006.01) |
| ***F21V 13/04*** | (2006.01) |
| ***F21V 29/76*** | (2015.01) |
| ***F21V 17/00*** | (2006.01) |
| ***F21V 17/12*** | (2006.01) |
| ***F21V 29/70*** | (2015.01) |
| *F21Y 115/10* | (2016.01) |
| *F21Y 101/02* | (2006.01) |

(52) U.S. Cl.
CPC ..... *F21V 17/002* (2013.01); *F21V 17/12* (2013.01); *F21V 17/164* (2013.01); *F21V 17/166* (2013.01); *F21V 29/70* (2015.01); *F21V 29/76* (2015.01); *F21Y 2101/02* (2013.01); *F21Y 2115/10* (2016.08)

(58) Field of Classification Search
CPC ..... F21V 14/00; F21V 13/02–13/04; F21V 17/00–17/20; G09F 13/00
See application file for complete search history.

(56) References Cited

U.S. PATENT DOCUMENTS

| | | | | |
|---|---|---|---|---|
| 4,345,308 | A | 8/1982 | Mouyard | |
| 5,309,342 | A | 5/1994 | Heinen | |
| 5,584,575 | A | 12/1996 | Fickel | |
| 5,619,789 | A | 4/1997 | Chung | |
| 5,673,997 | A | 10/1997 | Akiyama | |
| 5,738,436 | A | 4/1998 | Cummings et al. | |
| 5,951,151 | A | 9/1999 | Doubeck et al. | |
| 6,305,829 | B1 | 10/2001 | Thomas et al. | |
| 6,979,107 | B1 | 12/2005 | Benensohn | |
| 7,018,070 | B2 | 3/2006 | McCoy | |
| 7,120,969 | B2 | 10/2006 | Carls | |
| 7,438,433 | B1 | 10/2008 | Steadman et al. | |
| 7,487,584 | B1 | 2/2009 | Lee | |
| 7,959,332 | B2 | 6/2011 | Tickner et al. | |
| 8,070,328 | B1 | 12/2011 | Knoble et al. | |
| 8,096,670 | B2 | 1/2012 | Trott et al. | |
| 8,215,805 | B2 | 7/2012 | Cogliano et al. | |
| 8,220,970 | B1 | 7/2012 | Khazi et al. | |
| 8,337,055 | B2 | 12/2012 | Clifton | |
| 8,348,477 | B2 | 1/2013 | Tickner et al. | |
| 8,405,947 | B1 | 3/2013 | Green et al. | |
| 8,445,144 | B2 | 5/2013 | Utsugi et al. | |
| 8,491,166 | B2 | 7/2013 | Thompson, III | |
| 8,500,305 | B2 | 8/2013 | O'Sullivan et al. | |
| 8,602,601 | B2 | 12/2013 | Khazi et al. | |
| 8,727,583 | B2 | 5/2014 | Russo | |
| 2005/0265016 | A1 | 12/2005 | Rappaport | |
| 2007/0147052 | A1 | 6/2007 | Wyatt | |
| 2008/0080195 | A1 | 4/2008 | Steadman | |
| 2009/0086476 | A1 | 4/2009 | Tickner et al. | |
| 2009/0129086 | A1 | 5/2009 | Thompson, III | |
| 2010/0085759 | A1 | 4/2010 | O'Sullivan et al. | |
| 2010/0110699 | A1 | 5/2010 | Chou | |
| 2010/0226139 | A1 | 9/2010 | Lynch | |
| 2010/0246193 | A1 | 9/2010 | Clifton et al. | |
| 2011/0063849 | A1 | 3/2011 | Alexander | |
| 2011/0297971 | A1 | 12/2011 | Shimizu | |
| 2012/0120645 | A1 | 5/2012 | Hawkins | |
| 2012/0236563 | A1* | 9/2012 | Breidenassel | F21V 17/12 362/249.02 |
| 2013/0010476 | A1 | 1/2013 | Pickard | |
| 2013/0051012 | A1* | 2/2013 | Oehle | F21S 8/026 362/235 |
| 2013/0294077 | A1 | 11/2013 | Gabrius | |

* cited by examiner

OPTICAL ATTACHMENT FEATURES FOR LIGHT-EMITTING DIODE-BASED LIGHTING SYSTEM

CROSS-REFERENCE TO RELATED APPLICATIONS

This application is a continuation of and claims priority under 35 U.S.C. § 120 to U.S. patent application Ser. No. 13/746,835, entitled "Optical Attachment Features For Light-Emitting Diode-Based Lighting System," filed Jan. 22, 2013, which claims priority under 35 U.S.C. § 119 to U.S. Provisional Patent Application Ser. No. 61/588,537, titled "LED-Based Lighting System" and filed on Jan. 19, 2012. The entire contents of the foregoing applications are hereby incorporated herein by reference.

The present application is also related to a patent application titled "Light-Emitting Diode Driver Case," having U.S. patent application Ser. No. 13/463,107 and filed on May 3, 2012, the entire contents of which are hereby incorporated herein by reference.

The present application is also related to a patent application titled "Reflectors and Reflector Orientation Feature to Prevent Non-Qualified Trim," having U.S. patent application Ser. No. 13/465,779 and filed on May 7, 2012, the entire contents of which are hereby incorporated herein by reference.

The present application is further related to U.S. patent application Ser. No. 13/746,817, titled "Secondary Enclosure for Light-Emitting Diode-Based Lighting System," which is being filed concurrently with the U.S. Patent and Trademark Office.

The present application is further related to U.S. patent application Ser. No. 13/746,649, titled "Attachment Mechanisms for Light-Emitting Diode-Based Lighting System," which is being filed concurrently with the U.S. Patent and Trademark Office.

TECHNICAL FIELD

The present disclosure relates generally to light-emitting diode (LED)-based lighting systems, and more particularly, to optical attachment features for a LED-based lighting system.

BACKGROUND

Recessed lighting is used in a number of different applications. In a number of cases, recessed lighting uses LED technology to provide one or more of a number of benefits, including but not limited to decreased energy consumption, reduced maintenance, and increased efficacy. Optical devices (e.g., reflectors, lenses, diffusers) for LED-based lighting systems can vary in style, type, and features. One or a combination of such optical devices can dramatically change the way that light emitted by one or more LEDs is distributed from a fixture.

SUMMARY

In general, in one aspect, the disclosure relates to an optical attachment feature of a light-emitting diode (LED) lighting system. The optical attachment feature can include an enclosure having an enclosure wall forming a cavity and an enclosure collar having a first profile. The optical attachment feature can also include a trim having a trim collar that abuts to the enclosure collar, where the trim collar has a second profile. The optical attachment feature can further include a reflector having an outer surface, an inner surface having reflective material disposed thereon, and a reflector collar having a first optical attachment mechanism. The optical attachment feature can also include a diffuser having a diffuser collar, where the diffuser collar includes a second optical attachment mechanism and a third optical attachment mechanism, where the second optical attachment mechanism couples to the first optical attachment mechanism, and where the third optical attachment mechanism is disposed within a feature formed by the first profile and the second profile when the enclosure collar is mechanically coupled to the trim collar.

In another aspect, the disclosure can generally relate to an optical attachment feature of a light-emitting diode (LED) lighting system. The optical attachment feature can include an enclosure having an enclosure wall and an enclosure collar, where the enclosure wall comprises a first coupling feature, where the enclosure collar comprises a first optical attachment mechanism. The optical attachment feature can also include a reflector having an inner surface, an outer surface, and a reflector collar, where the outer surface includes a second coupling feature that couples to the first coupling feature, where the inner surface has a reflective material, and where the reflector collar includes a second optical attachment mechanism. The optical attachment feature can further include a diffuser that includes a diffuser collar having a third optical attachment mechanism and a fourth optical attachment mechanism, where the third optical attachment mechanism couples to the first optical attachment mechanism of the enclosure, and where the fourth optical attachment mechanism couples to the second optical attachment mechanism of the reflector collar.

In yet another aspect, the disclosure can generally relate to an optical attachment feature of a light-emitting diode (LED) lighting system. The optical attachment feature can include an enclosure comprising an enclosure wall forming a cavity and an enclosure collar having a first optical attachment mechanism. The optical attachment feature can also include a reflective device having an inner surface, where the inner surface comprises a reflective material. The optical attachment feature can further include a holder ring that includes a receiving feature and a second optical attachment mechanism, where the receiving feature detachably couples to the reflective device, and where the second optical attachment mechanism detachably couples to the first optical attachment mechanism of the enclosure collar.

These and other aspects, objects, features, and embodiments will be apparent from the following description and the appended claims.

BRIEF DESCRIPTION OF THE DRAWINGS

The drawings illustrate only example embodiments of optical attachment features for LED-based lighting systems and are therefore not to be considered limiting of its scope, as optical attachment features for LED systems may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
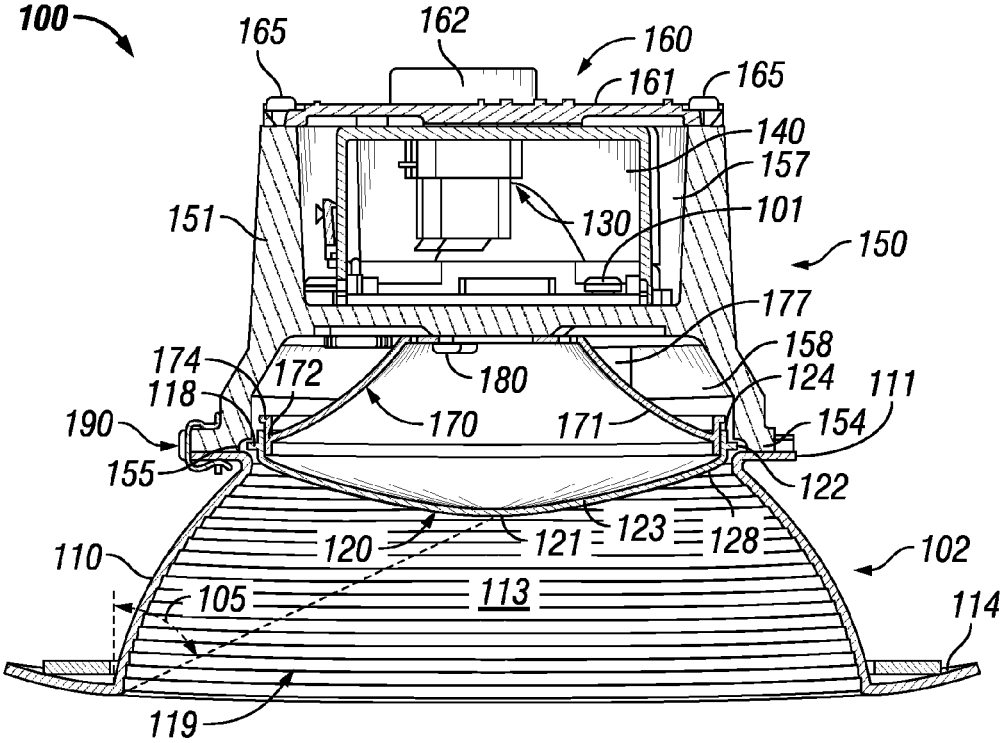
FIG. 1 shows a cross-sectional side view of an optical attachment feature for a LED-based lighting system in accordance with one or more example embodiments.

Example embodiments of optical attachment features for LED-based lighting systems will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and height can each generally be described as lateral directions.

While the example embodiments described herein are directed to LED-based lighting systems, example optical attachment features can also be used for other types of lighting systems (e.g., fluorescent lighting systems, organic LED lighting systems) and/or with other types of enclosures not related to lighting systems. Therefore, example optical attachment features described herein should not be considered limited to LED-based lighting systems.

Example optical attachment features can include one or more of a number of optical attachment mechanisms, examples of which are described below. Optical attachment features described herein are directed to mechanically coupling one or more optical features to each other and to another portion (e.g., an enclosure, a trim) of a LED-based lighting system. In such a lighting system, the optical features can affect one or more characteristics (e.g., color, intensity, distribution, shading) of light emitted by one or more LEDs in a LED-based lighting system. A user may desire to adjust and/or change such optical features to generate different characteristics of the light emitted by the LEDs for a given LED-based lighting system. By using example embodiments described herein, a user can adjust and/or change optical features of a LED-based lighting system quickly and easily. By using example embodiments, the LED-based lighting system (or certain components of the LED-based lighting system) can remain in place while the optical features are adjusted and/or changed.

Because some LED-based lighting systems are installed in spatially restrictive spaces (e.g., in a junction box, in a down can), removing and reinstalling the LED-based lighting system for the purpose of adjusting and/or changing optical features can be cumbersome and time consuming. Further removal and reinstallation of the LED-based lighting system can lead to failure of one or more components of the LED-based lighting system because of the restriction in space. Thus, example optical attachment features help extend the useful life of the LED-based lighting system by disturbing fewer components of the LED-based lighting system.

The example optical attachment features described herein allow the optical features to be adjusted, installed, and/or removed without the use of tools. Thus, example optical attachment features described herein allow a user to easily, without tools, change one or more optical features, access one or more portions of the LED-based lighting system, perform maintenance, adjust an optical feature, and/or perform some other task with respect to the LED-based lighting system.

In certain applications, the LED-based light systems using example optical attachment features are subject to one or more of a number of standards and/or regulatory requirements. For example, Underwriter's Laboratories (UL) publishes and maintains standard 1598, which applies to luminaires for use in non-hazardous locations with voltage of 600V nominal or less. Such standards and/or regulatory requirements can be applicable to one or more of a number of countries, including but not limited to the United States, Canada, and Mexico.

FIG. 1 shows a cross-sectional side view of an optical attachment feature 117 for a LED-based lighting system 100 in accordance with one or more example embodiments. In one or more embodiments, one or more of the features shown in FIG. 1 may be omitted, repeated, and/or substituted. Accordingly, embodiments of optical attachment features for LED-based lighting systems should not be considered limited to the specific arrangements of components shown in FIG. 1.

Referring now to FIG. 1, the LED-based lighting system 100 in this example includes an enclosure 150, a trim 102, a reflector 170, and a diffuser 120. In this case, the reflector 170 and the diffuser 120 are mechanically coupled to each other, and the coupled pair of the reflector 170 and the diffuser 120 is mechanically coupled to the trim 102 and the enclosure 150, as described below.

The enclosure 150 can include an enclosure wall 151 that forms one or more cavities. In this case, the enclosure wall 151 forms an upper cavity 157 and a lower cavity 158. Within the upper cavity 157 of the enclosure 150 can be one or more of a number of components of the LED-based lighting system 100. For example, as shown in FIG. 1, a LED driver 140, a luminaire disconnect 130, and a fastening device 101 can be disposed within the upper cavity 157. The upper cavity 157 of the enclosure 150 can be bounded by a top plate 161 of a top plate assembly. The top plate 161 can be attached to the enclosure wall 151 by one or more fastening devices 165 (e.g., screws, bolts). Optionally, as shown in FIG. 1, the top plate 161 can include a retainer 162 that is used to help receive a secondary enclosure (not shown) for the wire splice that results from the luminaire disconnect 130.

Within the lower cavity 158 of the enclosure 150 can be one or more of a number of components of the LED-based lighting system 100. For example, as shown in FIG. 1, one or more LEDs 180, the reflector 170, and the diffuser 120 are disposed within the lower cavity 158. More details about the enclosure 150 and the secondary enclosure can be found in U.S. patent application Ser. No. 13/746,817, titled "Secondary Enclosure for Light-Emitting Diode-Based Lighting System," which is being filed concurrently with the U.S. Patent and Trademark Office, the entire contents of which are hereby incorporated by reference.

In certain example embodiments, the enclosure 150 also includes an enclosure collar 154. The enclosure collar 154 can have, along the inner surface of the enclosure wall 151 within the lower cavity 158, a profile that can be used as part of an example optical attachment feature 117. Specifically, in this case, there is a recess 155 disposed in the inner surface of the enclosure wall 151 where the enclosure collar 154 is located. Put another way, the enclosure collar 154 has a profile that is defined, at least in part, by the recess 155.

The trim 102 can include one or more of a number of features, including but not limited to a trim collar 111, a fastening device 112, a base 114, a trim body 110 that defines a passage 119, and baffling 113 disposed along the inner surface of the trim body 110. Further, the trim body 110 (particularly the inner wall) can be made of and/or coated with a reflective material or material having other features that can contribute to a desired optical effect. Such materials can include, but are not limited to, aluminum, alloy, and glass.

The trim collar 111 can mechanically couple to the enclosure collar 154, which causes the enclosure 150 to be mechanically coupled to the trim 102. The trim collar 111 and the enclosure collar 154 can be coupled to each other in one or more of a number of ways, as described in U.S. patent application Ser. No. 13/746,649, titled "Attachment Mechanisms for Light-Emitting Diode-Based Lighting System," which is being filed concurrently with the U.S. Patent and Trademark Office, the entire contents of which are hereby incorporated by reference.

For example, an attachment mechanism 190 can be used to apply a compressive force to the trim collar 111 and the enclosure collar 154, forcing the trim 102 and the enclosure 150 to be mechanically coupled to each other. In such a case, the attachment mechanism 190 can be hingedly coupled to the trim collar 111 by the fastening device 112 that extends away from the bottom surface of the trim collar 111. In any case, the attachment mechanism 190 can be removable, allowing the trim 102 to be separated from the enclosure 150.

The trim collar 111 has a different profile than the profile of the enclosure collar 154. Specifically, while at least a portion of the trim collar 111 abuts against a portion of the enclosure collar 154, another portion of the trim collar 111 extends inward beyond where the recess 155 causes a physical separation between the trim collar 111 and the enclosure collar 154. For example, as shown in FIG. 1, the trim collar 111 extends inward to approximately the point where the inner wall of the enclosure wall 151 would extend in the absence of the recess 155. Thus, the trim collar 111 (or at least the inward portion of the trim collar 111) is part of the optical attachment feature 117.

While the enclosure collar 154 shown in FIG. 1 is located at the bottom end of the enclosure 150, the enclosure collar 154 can be located at any other location on the enclosure 150. The enclosure collar 154 can be located on the exterior and/or the interior of the enclosure 150. In any event, the enclosure collar 154 is positioned in a location on the enclosure 150 that is accessible to the trim collar 111 so that the trim collar 111 and the enclosure collar 154 can mate (abut) and be mechanically coupled to each other by the attachment mechanism 190.

Similarly, while the trim collar 111 shown in FIG. 1 is located at the top end of the trim 102, the trim collar 111 can be located at any other location on the trim 102. The trim collar 111 can be located on the exterior and/or the interior of the trim 111. In any event, the trim collar 111 154 is positioned in a location on the trim 102 that is accessible to the enclosure collar 154 so that the trim collar 111 and the enclosure collar 154 can mate (abut) and be mechanically coupled to each other by the attachment mechanism 190.

In certain example embodiments, the reflector 170 is a type of optical device that is removably coupled to a portion of the enclosure 150. The reflector 170 can be coupled to the enclosure in one or more of a number of ways, including but not limited to clips, mating threads, snaps, fastening devices and receivers, and slots. For example, as shown in FIG. 1 (and also in FIG. 7 below), a fastening device 101 (e.g., a threaded screw, a threaded bolt) can traverse an aperture in the enclosure wall 151 and threadably couple to an aperture in a mounting receiver 177 of a mounting feature 176. Such a mounting feature 176 can be disposed on an outer surface of the reflector body 171. Details of the mounting receiver 177 and other related components of the mounting feature are described below in FIG. 5.

The LEDs 180 may be coupled to the inner surface of the lower cavity 158 of the enclosure 150 or to the reflector 120 at the top of the reflector 120. The LED 180 may be positioned close enough to the enclosure wall 151 so that some or all of the heat generated by the LED 180 is absorbed by the enclosure wall 151. The reflector 120 (especially the inner surface of the reflector body 171) may be coated with and/or made of one or more of a number of reflective materials. The reflective material of the reflector 120 may be the same material and/or a different material from the reflective material used for the trim 110. The upper reflector may be made of one or more of a number of suitable materials, including but not limited to aluminum, alloy, and glass.

In certain example embodiments, the reflector 170 is positioned atop the diffuser 120. Specifically, as shown in FIG. 1, the outer edge of the reflector body 171 includes a reflector collar 172, which extends downward away from the reflector body 171. In addition, an optical attachment mechanism 174 (in this case, a protrusion) can extend radially away from the reflector collar 172. The reflector collar 172 and/or the optical attachment mechanism 174 can be disposed along the entire perimeter of the outer edge of the reflector body 171 or in one or more segments of the perimeter of the outer edge of the reflector body 171. Some or all of the reflector collar 172 and the optical attachment mechanism 174 can be part of the optical attachment feature 117.

The diffuser 120 is another type of optical device that is removably coupled to the reflector 170, the enclosure 150, and/or the trim 102. The diffuser 120 (also called, among other terms, a lens) may have refractive and/or reflective properties to process light generated by the LED 180 in a particular manner consistent with the design of the LED-based lighting system 100. The diffuser 120 may be constructed of one or more of a number of suitable materials, including but not limited to glass and plastic. In certain example embodiments, the diffuser 120 is not included in the LED-based lighting system 100. If included, the diffuser 120 may have little or no refractive and/or reflective properties.

The reflector collar 172 and the diffuser collar 124 shown in FIG. 1 are positioned along an outer perimeter of the reflector 170 and the diffuser 120, respectively. However, the reflector collar 172 can be located at any point or points along the reflector 170. Likewise, the diffuser collar 124 can be located at any point or points along the diffuser 120.

As an example of a diffuser 120 with optical properties, FIG. 1 shows that the diffuser 120 can be designed with three different radii along the surface of the diffuser 120. Radius A 121 may be of such a radius as to increase the mixing chamber height, which reduces the hot spot from the LED 180 and provides more uniform brightness across the diffuser 120. Radius B 123 may be a nearly linear section (very large radius) that improves the optical cutoff 105. The optical cutoff 105 may be a distance of such a radius (e.g., Radius C 128) as to remove the amount of light emitted from the reflector 170. In such a case, the light emitted by the LED-based lighting system 100 may aesthetically and/or optically mimic a known lighting system.

The diffuser 120 can include a diffuser collar 124, which can extend generally upward away from the diffuser 120. In addition, an optical attachment mechanism 122 (in this case, a protrusion) can extend radially away from the diffuser collar 124. The diffuser collar 124 and/or the optical attachment mechanism 122 can be disposed along the entire perimeter of the outer edge of the diffuser 120 or in one or more segments of the perimeter of the outer edge of the diffuser 120. Some or all of the diffuser collar 124 and the optical attachment mechanism 122 can be part of the optical attachment feature 117. Specifically, the configuration of the diffuser 120 and the reflector 170 can allow the diffuser 120 and the reflector 170 to mechanically couple to each other. In this example, the optical attachment mechanism 174 of the reflector 170 can be positioned atop the end of the diffuser collar 124, and the outer surface of the reflector collar 172 can be adjacent to the inner surface of the diffuser collar 124.

In such a case, when the reflector 170, diffuser 120, enclosure 150, and trim 102 are assembled as shown in FIG. 1, the recess 155, the optical attachment mechanism 122, the diffuser collar 124, the optical attachment mechanism 174, the reflector collar 172, and the trim collar 111 form an optical attachment feature 117. Specifically, the optical attachment mechanism 122 of the diffuser 120 is positioned within the recess 155 formed by the trim collar 111 and the enclosure collar 154, which secures the diffuser 120. In addition, the optical attachment mechanism 174 of the reflector 170 is positioned atop the end of the diffuser collar 124, and the outer surface of the reflector collar 172 is positioned adjacent to the inner surface of the diffuser collar 124, which secures the reflector 170.

In addition (or in the alternative) to what is described above, the reflector 170, diffuser 120, enclosure 150, and/or trim 102 can be coupled to each other in one or more of a number of ways, using one or more of a number of coupling features. Such coupling features can include, but are not limited to, clips, mating threads, slots, tabs, fastening devices, slings, and snap fittings. Such coupling features can be detachable, to allow one or more components (e.g., diffuser 120, reflector 170) to be adjusted, removed, and/or attached. Examples of such coupling features are described below with respect to FIGS. 3A-5, FIGS. 6 and 7, FIGS. 8A-8C, and FIGS. 9A-9C.

In addition to, or instead of, a protrusion, the optical attachment mechanism 122 and the optical attachment mechanism 174 can be one or more of a number of optical attachment mechanisms with one or more of a number of features. For example, an optical attachment mechanism can be a channel or slot, as described below with respect to FIGS. 11A and 11B.

Figure 2:
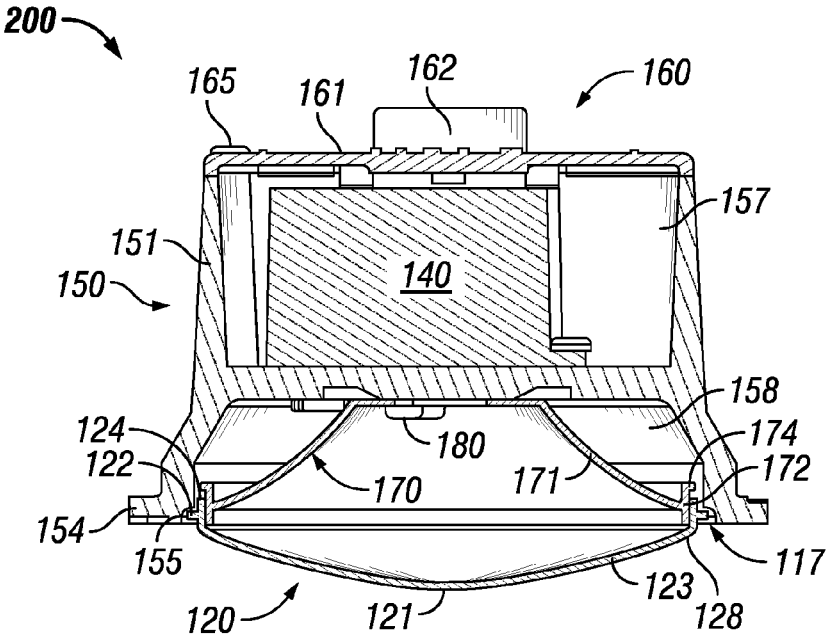
FIG. 2 shows a cross-sectional side view of a portion of the optical attachment feature for the LED-based lighting system of FIG. 1 in accordance with one or more example embodiments.

FIG. 2 shows a cross-sectional side view of a portion 200 of the optical attachment feature 117 for the LED-based lighting system 100 of FIG. 1 in accordance with one or more example embodiments. Specifically, referring to FIGS. 1 and 2, the trim 102 and the attachment mechanism 190 of FIG. 1 are removed in FIG. 2, and so the trim collar 111 is missing from the optical attachment feature 117 of FIG. 1. Thus, FIG. 2 shows in more detail how the optical attachment mechanism 122 of the diffuser 120 is disposed within the recess 155 of the trim collar 154.

Figure 3A:
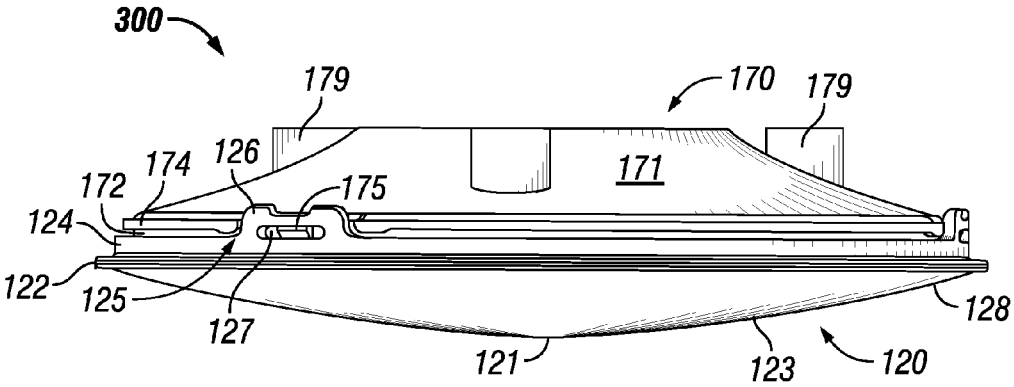
FIGS. 3A-3C show various views of a portion of the optical attachment feature for the LED-based lighting system of FIG. 1 in accordance with one or more example embodiments.
Figure 3B:
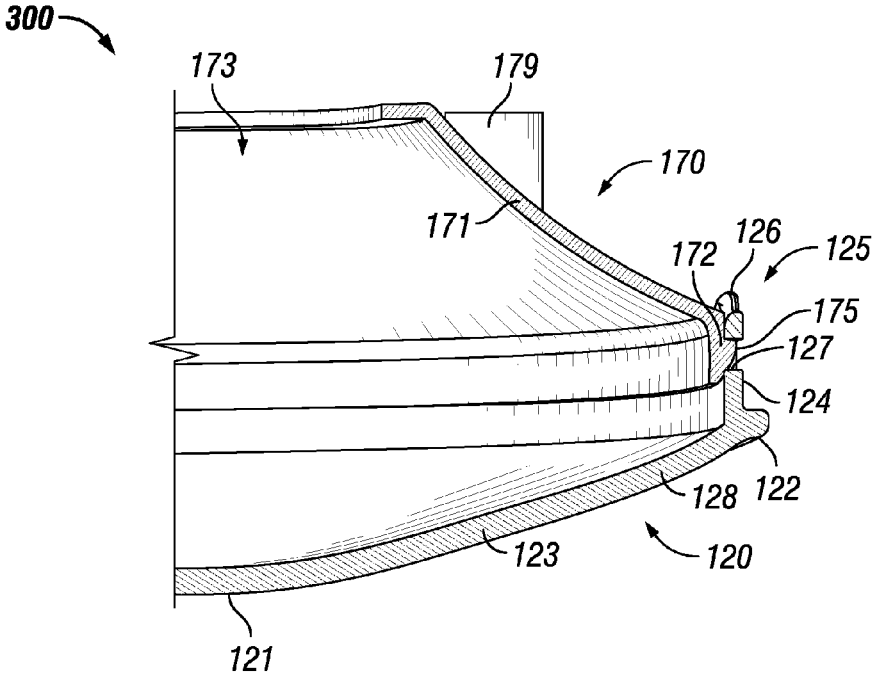
Figure 3C:
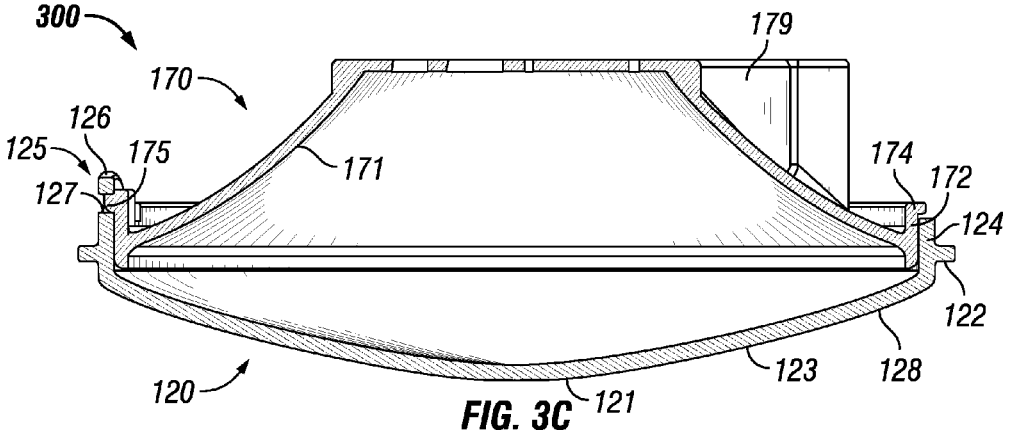

FIGS. 3A-3C show various views of a different example optical attachment feature 125 for a portion 300 of the LED-based lighting system 100 of FIG. 1 in accordance with one or more example embodiments. Specifically, FIG. 3A shows a side view of the reflector 170 mechanically coupled to the diffuser 120 using the optical attachment feature 125. FIGS. 3B and 3C show a cross-sectional side view of the reflector 170 mechanically coupled to the diffuser 120 using the optical attachment feature 125.

Referring to FIGS. 1-3C, in addition to the features described above with respect to the reflector 170 and the diffuser 120, the optical attachment feature 125 is shown. The optical attachment feature 125 allows the reflector 170 and the diffuser 120 to be mechanically and detachably coupled to each other. The optical attachment feature 125 includes an optical attachment mechanism 126 that is disposed on the diffuser collar 124 and a corresponding optical attachment mechanism 175 that is disposed on the reflector collar 172.

The optical attachment mechanism 126 and the corresponding optical attachment mechanism 175 can be one or more of a number of optical attachment mechanisms. Examples of such optical attachment mechanisms can include, but are not limited to, mating threads, snaps, straps, slots, and fastening devices. In this example, the optical attachment mechanism 126 is a tab receiver, which includes an aperture 127 that traverses a portion of the tab receiver, and the corresponding optical attachment mechanism 175 is a tab that protrudes through the aperture 127 when the reflector 170 is properly aligned with the diffuser. In such a case, the optical attachment mechanism 126 and the corresponding optical attachment mechanism 175 allow the diffuser 120 and the reflector 170 to be mechanically coupled to each other. To decouple the diffuser 120 and the reflector 170, the optical attachment feature 125 can be undone by applying an inward force on the corresponding optical attachment mechanism 175 (e.g., tab) and/or applying an outward force on the upper portion of the optical attachment mechanism 126 (e.g., tab receiver).

Figure 4:
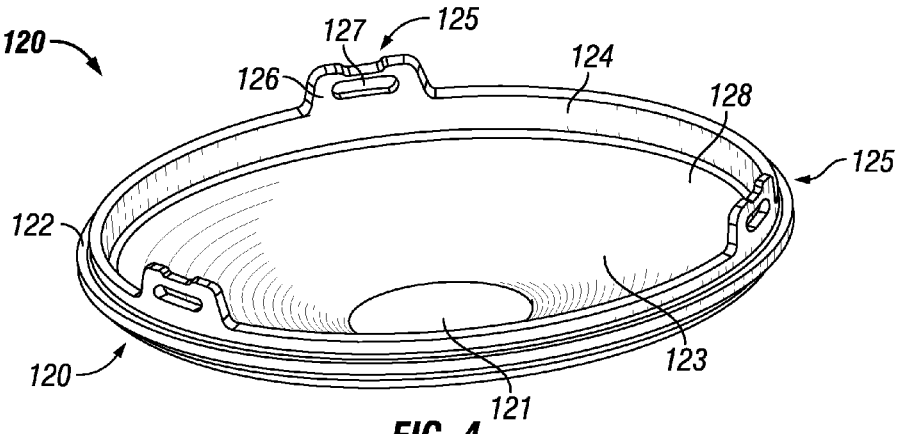
FIG. 4 shows a perspective view of the diffuser of FIG. 1 in accordance with one or more example embodiments.

There can be any number of optical attachment features 125 disposed along any portions of the diffuser 120 and/or the reflector 170. In this case, there are three optical attachment features 125 that are distributed substantially equidistantly from each other along the outer perimeter of the diffuser 120 and the reflector 170. FIG. 4 shows a perspective view of the diffuser of FIGS. 1-3C, providing a view of the three optical attachment mechanisms 126 disposed along the diffuser collar 124. FIG. 4 also shows the optical attachment mechanism 122 that extends from the diffuser collar 124, as well as the three different segments (i.e., Radius A 121, Radius B 123, and Radius C 128) of the diffuser 120.

Figure 5:
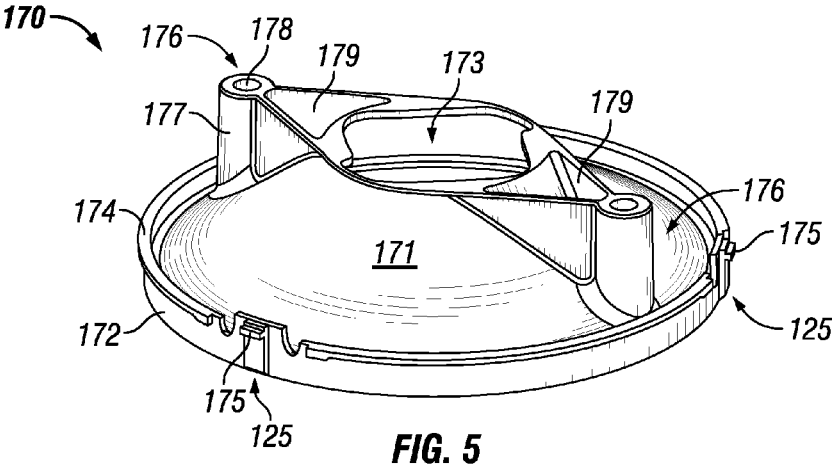
FIG. 5 shows a perspective view of the reflector of FIG. 1 in accordance with one or more example embodiments.

FIG. 5 shows a perspective view of the reflector 170 of FIG. 1 in accordance with one or more example embodiments. Referring to FIGS. 1-5, the corresponding optical attachment mechanism 175 (in this case, the tab) of the optical attachment feature 125 is shown. Also shown are two mounting features 176 that are symmetrical about an aperture 173 that traverses the top of the reflector 170. A mounting feature 176 can have any of a number of components and/or features that allow the reflector to be detachably coupled to the enclosure 150 and/or the trim 102. In certain example embodiments, each mounting feature 176 is disposed on an outer surface of the reflector body 171 and is not disposed on the inner surface of the reflector body 171. Similarly, each optical attachment feature (e.g., optical attachment feature 125, optical attachment feature 117) is also not disposed on the inner surface of the reflector body 171. In other words, all of the mounting features 176 and the optical attachment features are outside the optical field. As a result, there are not "black spots" or other optical anomalies that are created by the presence of the mounting device 176.

In this case, each mounting feature 176 includes a mounting receiver 177 and a support structure 179 that keeps the mounting receiver 177 solidly anchored to the outer surface of the reflector body 171. The mounting receiver 177 in this case includes an aperture 178 bounded by threaded walls for receiving the fastening device 101 (e.g., a screw or bolt). In addition, or in the alternative, the mounting feature 176 can have other components, including but not limited to clips, slots, mating threads, and recesses. Similarly, the enclosure 150 can include one or more of a number of components that complement the components of the mounting feature 176 so that the reflector 170 can be detachably coupled to the enclosure 150.

Figure 6:
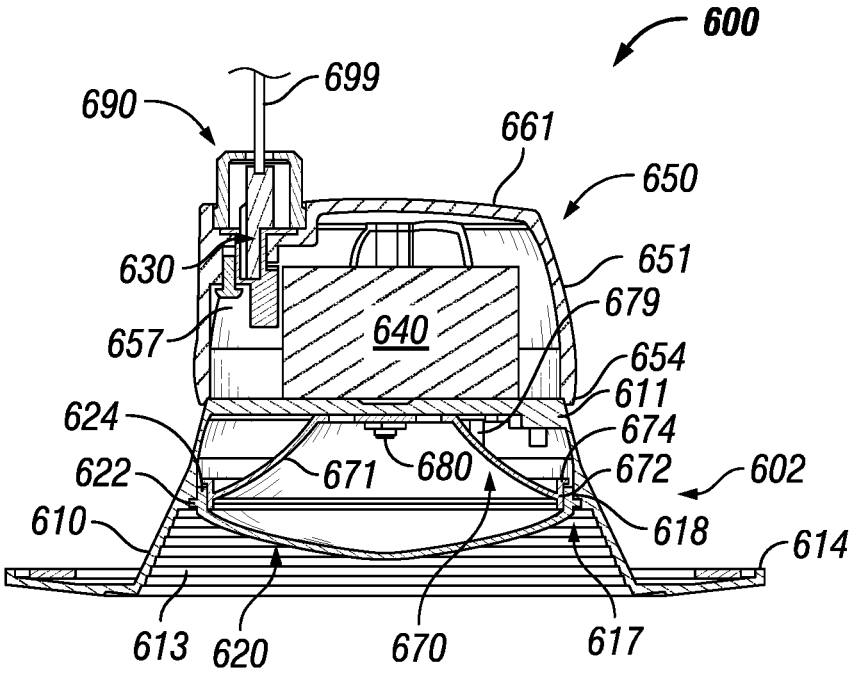
FIG. 6 shows a cross-sectional side view of an optical attachment feature for another LED-based lighting system in accordance with one or more example embodiments.

FIG. 6 shows a cross-sectional side view of an optical attachment feature 617 for another LED-based lighting system 600 in accordance with one or more example embodiments. One or more of the features shown in FIG. 6 may be omitted, repeated, and/or substituted. Accordingly, embodiments of LED-based lighting systems using optical attachment features should not be considered limited to the specific arrangements of components shown in FIG. 6. The LED-based lighting system 600 is substantially similar to the LED-based lighting system 100 described above with respect to FIG. 1, except as described below.

In this example, the enclosure wall 651 of the enclosure 650 forms only a single cavity 657. One or more of a number of components of the LED-based lighting system 600 can be disposed within the cavity 657 and/or on a surface of the enclosure wall 651. Here, for example, the LED driver 640 and a luminaire disconnect 630 are disposed within the cavity 657, while a secondary disconnect 690 is coupled to the top end 661 of the enclosure 650.

The bottom portion 654 of the enclosure 650 can be equivalent to the enclosure collar of FIG. 1. The bottom portion 654 in FIG. 6 can have one or more of a number of features that complement features in a top portion 611 of the trim 602 and allow the enclosure 650 to couple to the trim 602. Such features can include, but are not limited to, mating threads, slots, protrusions, apertures, and fastening devices. Further, while the bottom portion 654 of the enclosure 650 is shown in FIG. 6 to be at the bottom of the enclosure 650, and while the top portion 611 of the trim 602 is shown in FIG. 6 to be at the top of the trim 602, the location of the bottom portion 654 of the enclosure 650 and/or of the top portion 611 of the trim 602 can vary.

An example optical attachment feature 617 is shown in FIG. 6. Specifically, portions of the trim 602, the diffuser 620, and the reflector 670 combine to form the optical attachment feature 617. The inner surface of the trim body 610 includes an optical attachment feature 618. In this example, the optical attachment feature 618 is a protrusion that extends inward from the inner surface of the trim body 610. The size and location of the optical attachment feature 618 relative to the shape and size of the inner surface of the trim body 610 and the size and shape of the diffuser 620 allow the optical attachment features 622 of the diffuser 620 to couple to (e.g., abut against) the optical attachment feature 618 of the trim 602. In certain example embodiments, the optical attachment features 622 of the diffuser 620 couple to the optical attachment feature 618 of the trim 602 when the optical attachment features 674 of the reflector 670 are coupled to (e.g., abut against) the optical attachment features 622 and/or the diffuser collar 624 of the diffuser 620.

The optical attachment features 622, the diffuser collar 624, the optical attachment features 674, and the reflector collar 672 can be substantially similar to the corresponding features of the diffuser 120 and the reflector 170 described above with respect to FIGS. 1-5. Thus, the diffuser 620 and the reflector 670 of FIG. 6 can be coupled to each other in a manner substantially similar to how the diffuser 120 and the reflector 170 of FIGS. 1-5 are coupled to each other.

Figure 7:
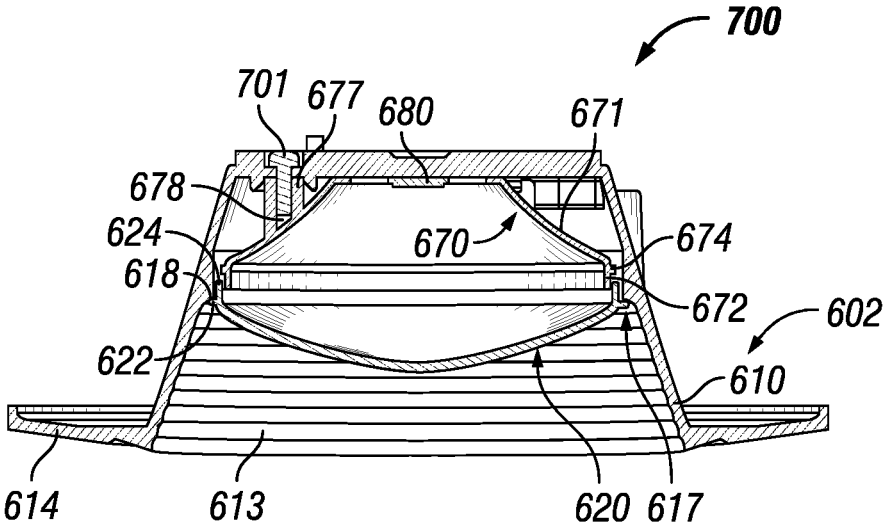
FIG. 7 shows a cross-sectional side view of a portion of the LED-based lighting system using the optical attachment feature of FIG. 6 in accordance with one or more example embodiments.

FIG. 7 shows a cross-sectional side view of a portion 700 of the LED-based lighting system 600 using the optical attachment feature 617 of FIG. 6 in accordance with one or more example embodiments. Here, in FIG. 7, the enclosure 650 is removed. Further, the coupling feature 676 for coupling the reflector 670 to the trim 602 is shown. In this example, the fastening device 701, the aperture in the trim 602, and the support structure (not shown), the mounting receiver 677, and the aperture 678 disposed on an outer surface of the reflector body 671 is substantially similar to the corresponding components described above with respect to FIGS. 1-5. In certain example embodiments, the trim 602 can be an optional component of the LED-based lighting system 600, and the optical attachment feature 618 can be disposed on the enclosure wall 651 of the enclosure 650.

Figure 8A:
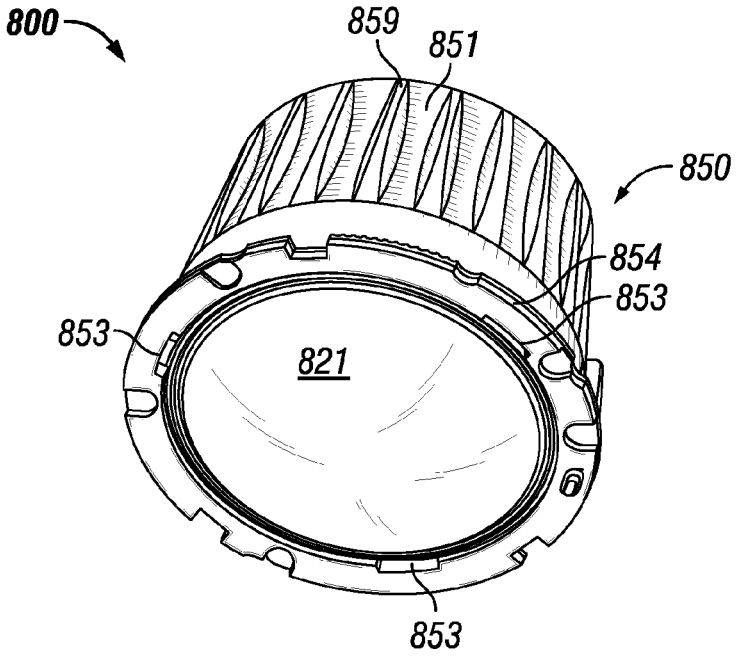
FIGS. 8A-8C show various views of another optical attachment feature for a LED-based lighting system in accordance with one or more example embodiments.
Figure 8B:
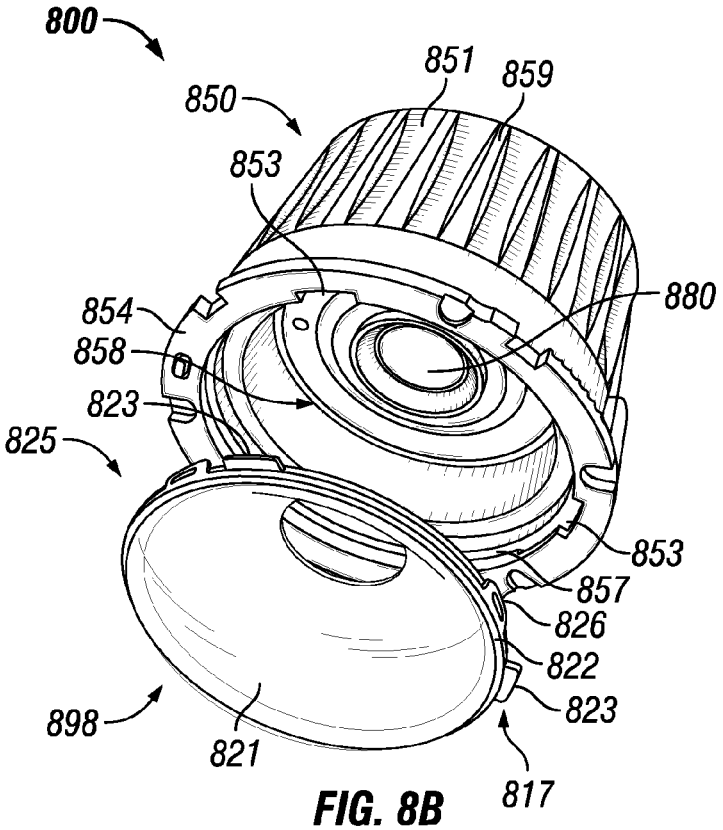
Figure 8C:
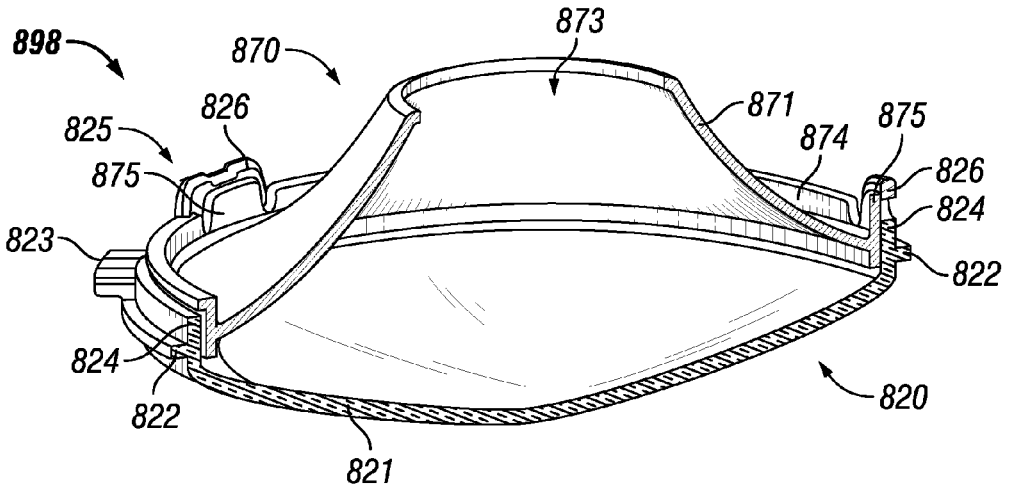

FIGS. 8A-8C show various views of another optical attachment feature 817 for a LED-based lighting system 800 in accordance with one or more example embodiments. Specifically, FIG. 8A shows a bottom perspective view of the LED-based lighting system 800. FIG. 8B shows an exploded view of the LED-based lighting system 800, and FIG. 8C shows a cross-sectional side perspective view of a portion 898 of the LED-based lighting system 800. One or more of the features shown in FIGS. 8A-8C may be omitted, repeated, and/or substituted. Accordingly, embodiments of LED-based lighting systems using optical attachment features should not be considered limited to the specific arrangements of components shown in FIGS. 8A-8C.

The LED-based lighting system 800 is substantially similar to the LED-based lighting system 100 described above with respect to FIG. 1. For example, the reflector 870 is substantially the same as the reflector 170 of FIGS. 1-5. Further, the reflector 870 can have one or more optical attachment mechanisms (e.g., optical attachment mechanism 875, optical attachment mechanism 874) to couple the reflector 870 to the diffuser 820. Some differences in the LED-based lighting system 800 relative to the LED-based lighting system 100 described above with respect to FIG. 1 are as described below.

Referring to FIGS. 1-8C, the LED based lighting system 800 includes an enclosure 850 that has an enclosure wall 851 with a number of protrusions 857 (e.g., fins) to aid in the dissipation of heat absorbed by the enclosure wall 851. The enclosure 850 can have an upper cavity (not shown) and a lower cavity 858. The enclosure wall 851 leading to the lower cavity 858 can include a coupling feature, such as the coupling feature 101 described above with respect to FIGS. 1-5. Further, the LEDs 880 can be disposed within the lower cavity 858.

The enclosure 850 can also include an enclosure collar 854 having one or more optical attachment features 817. For example, as shown in FIG. 8B, the enclosure collar 854 can include one or more recesses 853. Here, there are three recesses 853 that extend outward from the inner wall of the enclosure collar 854. At the end (in this case, the top) of each recess 853 is a slot 857 that connects to the end of the recess and extends laterally away from the recess for some distance. In certain example embodiments, the slot 857 terminates before reaching the adjacent recess 853. The slot 857 can have one or more of a number of features to help retain a component (e.g., a tab, described below) within the slot 857. Such a feature can include, but is not limited to, a detent, a raised portion, and an additional recess that travels further toward the top end of the enclosure 850.

In certain example embodiments, the diffuser 820 includes multiple optical attachment mechanisms. For example, in FIGS. 8A-8C, the diffuser 820 includes optical attachment mechanism 824 (i.e., the diffuser collar 824) and optical attachment mechanism 826 (i.e., the tab receiver 826) that is substantially similar to the diffuser collar 124 and tab receiver 126 described above with respect to FIGS. 1-5. The optical combination 898 of the diffuser 820 coupled to the reflector 870 is shown in FIG. 8C.

An additional optical attachment mechanism of the optical attachment feature 817 can be a number of tabs 823 that protrude outward at intervals from the diffuser collar 824 of the diffuser 820. Such tabs 823 can be sized, shaped, and positioned in such a way to mate with the recess 852 and slot 857 in the enclosure collar 854 of the enclosure 850. Thus when the optical combination 898 of the diffuser 820 and the reflector 870 are coupled to each other, rotating the tabs 823 of the diffuser 820 in the appropriate direction within the slots 857 of the enclosure collar 854 and sliding the tabs 823 out from the recesses 853 of the enclosure collar 854 allows a user to remove the optical combination 898 from the enclosure 850. In such a case, there may be no coupling feature disposed on an outer surface of the reflector 870 and/or in the enclosure wall 851.

In certain example embodiments, a trim (not shown) can be included in the LED-based lighting system 800. In such a case, the trim can be mechanically coupled to the enclosure in one or more of a number of ways. For example, an attachment mechanism, as described above with respect to FIG. 1, can be used to couple the trim to the enclosure 850.

Figure 9A:
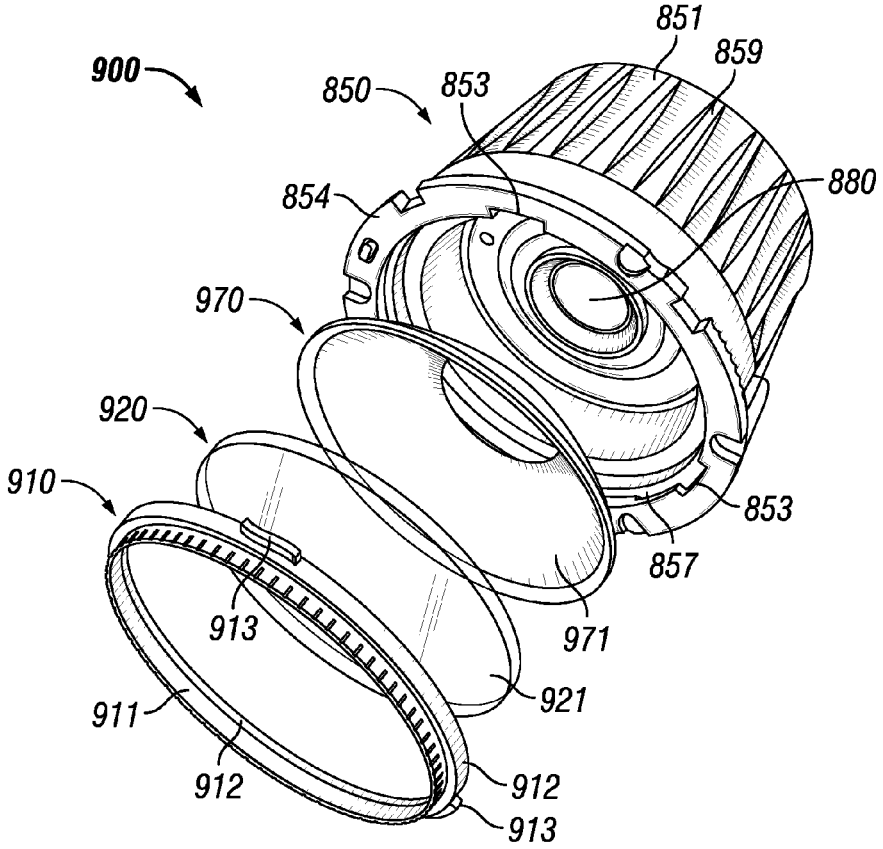
FIGS. 9A-9C show various views of yet another optical attachment feature for the LED-based lighting system of FIGS. 8A-8C in accordance with one or more example embodiments.
Figure 9B:
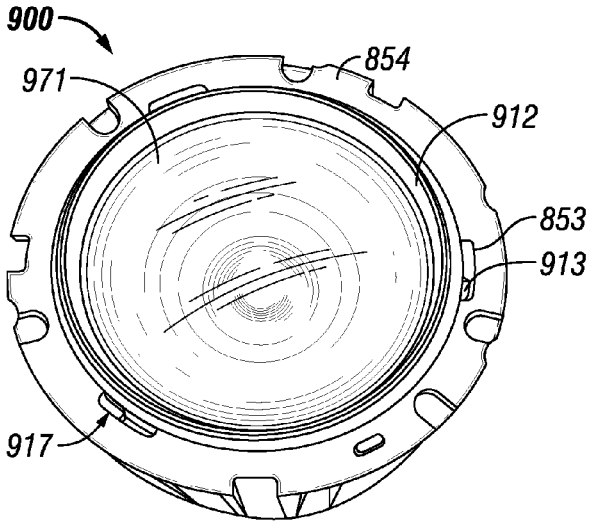
Figure 9C:
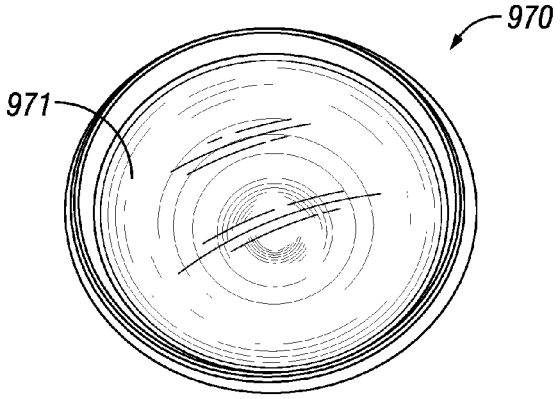

FIGS. 9A-9C show various views of yet another optical attachment feature 917 for an LED-based lighting system 900 in accordance with one or more example embodiments. Specifically, FIG. 9A shows an exploded view of the LED-based lighting system 900. FIG. 9B shows a bottom view of the LED-based lighting system 900, and FIG. 9C shows a front view of a type of reflector 970 of the LED-based lighting system 900. One or more of the features shown in FIGS. 9A-9C may be omitted, repeated, and/or substituted. Accordingly, embodiments of LED-based lighting systems using optical attachment features should not be considered limited to the specific arrangements of components shown in FIGS. 9A-9C.

The LED-based lighting system 900 is substantially similar to the LED-based lighting system 800 described above with respect to FIG. 8. For example, the enclosure 850 and its various components (e.g., LED 880) and features (e.g., recesses 853, slots 857) are substantially the same as the enclosure 850 and the corresponding components and features in FIG. 8. Some differences in the LED-based lighting system 900 relative to the other LED-based lighting systems described here are as described below.

The reflector 970 in this case is a hybrid lens and can be used for beam-forming optics. The size (e.g., length, width, height) and/or shape can be substantially the same as those of the reflector 870 of FIGS. 8A-8C, so that the reflector 970 can be disposed within the same enclosure 850. This allows a user to change from conventional downlight performance (using the reflector 870) to optional beam forming optics without the use of tools. The reflector 970 of FIGS. 9A-9C can have one or more optical attachment features (not shown), similar to the optical attachment features of the reflector 870 and/or the diffuser 820.

Alternatively (or in addition), a holder ring 910 can be used to incorporate one or more optical attachment features. For example, the holder ring 910 shown in FIGS. 9A and 9B include a number of tabs 913 that protrude outward from the outer surface of the holder ring 910. Such tabs 913 can be used in place of the tabs 823 of the diffuser collar 824 described above with respect to FIGS. 8A-8C. As another example, the holder ring 910 can include a recess 912 disposed along the inner surface 911 of the holder ring 910. The recess 912 can be disposed along all (as shown in FIG. 9A) or portions of the inner surface 911 of the holder ring 910. Such a recess 912 can be used to retain the reflector 970 and the optional diffuser 920. Thus, when the reflector 970 is coupled to the recess 912 and the tabs 913 are coupled to the slots 857, the reflector 970, the holder ring 910, and the enclosure 850 are detachably coupled together.

Figure 10A:
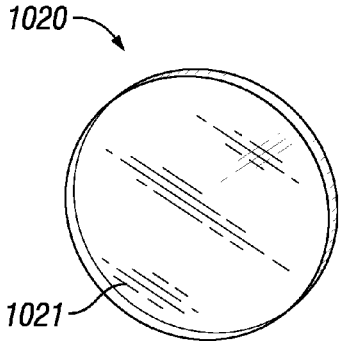
FIGS. 10A-10C show diffusers that can be used with the optical attachment feature of FIGS. 9A and 9B in accordance with one or more example embodiments.
Figure 10B:
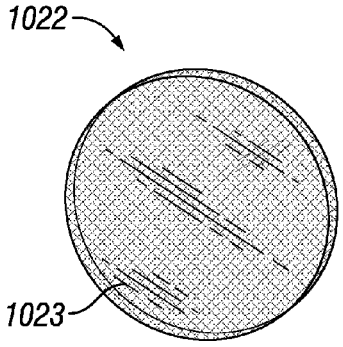
Figure 10C:
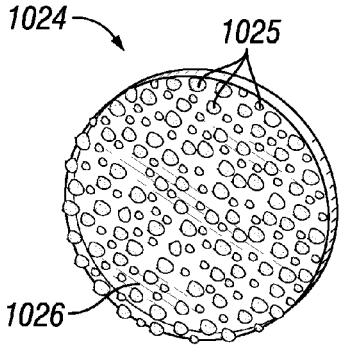

The optional diffuser 920 can also have different characteristics compared to the diffusers discussed above. In this case, because the reflector 970 is a hybrid lens, there may be no need for additional treatment of the light emitted by the LEDs 880. In such a case, the diffuser 920 can be omitted from the LED-based lighting system 900. Alternatively, the diffuser 920 can be some other type of media. Examples of such media are shown below with respect to FIGS. 10A-10C. FIG. 10A shows a diffuser 1020 with a diffuser surface 1021 that is slightly tinted. FIG. 10B shows a diffuser 1022 with a diffuser surface 1023 that is heavily tinted. FIG. 10C shows a diffuser 1024 with a diffuser surface 1026 that has a number of raised features 1025 disposed throughout the diffuser surface 1026. As yet another alternative, the diffuser 920 can be substantially similar to the diffusers described above. In any case, the diffuser 920 can have a size and/or shape that allows the diffuser 920 to be secured between the holder ring 910 and the reflector 970 when the LED-based lighting system 900 is assembled.

Figure 11A:
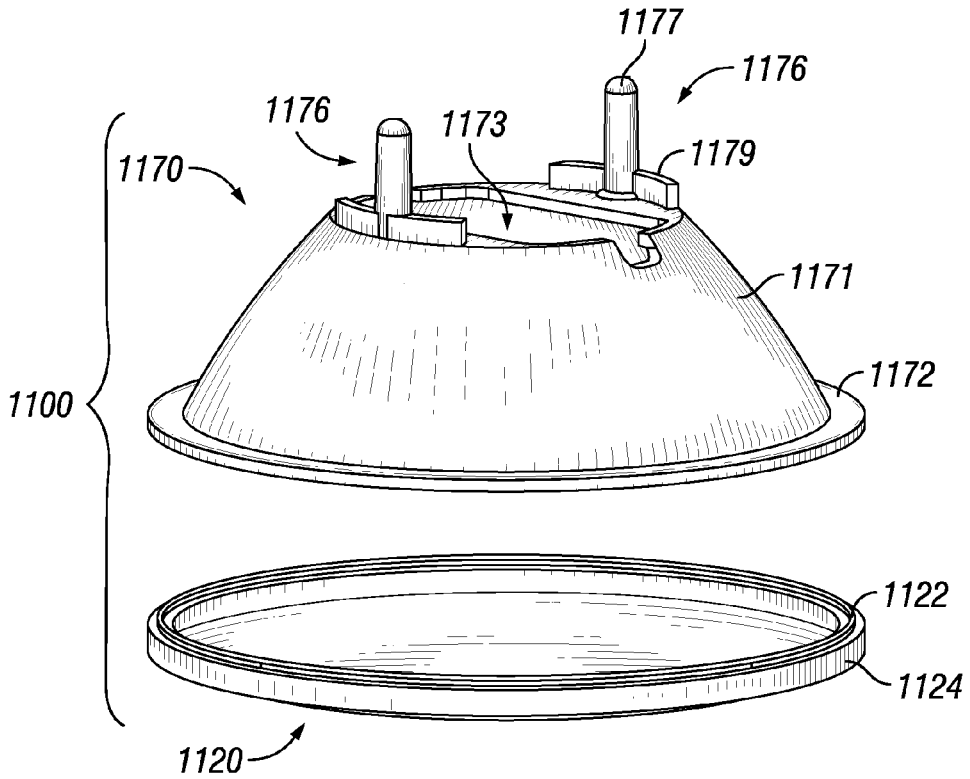
FIGS. 11A and 11B show various views of still another optical attachment feature for a LED-based lighting system in accordance with one or more example embodiments.
Figure 11B:
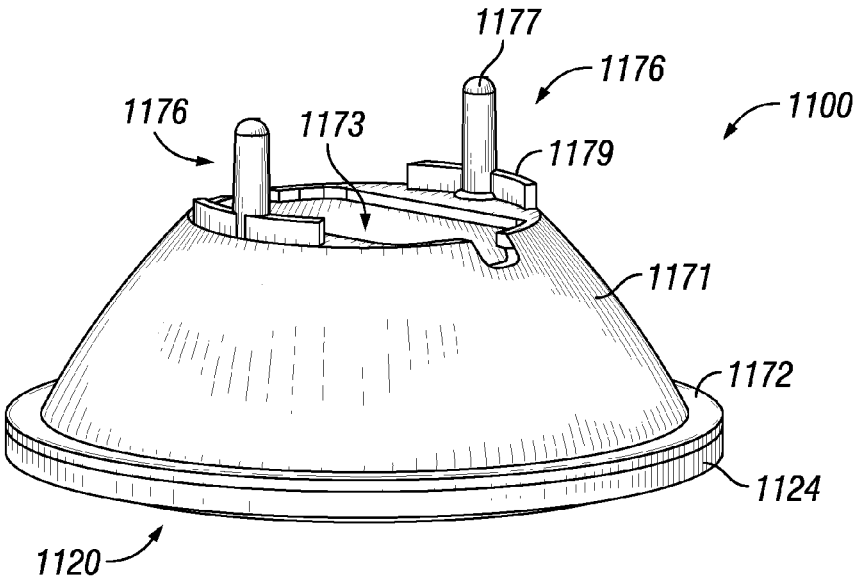

FIGS. 11A and 11B show perspective views of an alternative optical attachment mechanism 1117 of a LED-based lighting system 1100 in accordance with certain example embodiments. Specifically, an ultrasonic weld may be used to couple the diffuser 1120 to the reflector 1170. In such a case, the diffuser 1120 may include a diffuser collar 1124 that extends vertically from some or all of the top of the diffuser 1120. The diffuser collar 1124 may include, as part of the optical attachment mechanism 1117, an energy director 1122. The energy director 1122 may be a protrusion of material from one or more parts of the diffuser 120 and/or diffuser collar 1124. In FIG. 11A, the energy director 1122 is a protrusion from the top of the diffuser collar 1124. The reflector 1170 may also include a reflector collar 1172 that provides a mating surface with the diffuser collar 1124 of the diffuser 1120.

As the diffuser 1120 is positioned proximately to the reflector 1170, energy in one or more forms may be used to melt the energy director 1122 so that the diffuser 1120 couples to the reflector 1170. For example, a machine may be used to apply pressure and high frequency vibrations to the diffuser collar 1124 of the diffuser 1120 and the reflector collar 1172 of the reflector 1170. The pressure and high frequency vibrations can melt the energy director 1122, which in turn bonds the diffuser collar 1124 to the reflector collar 1172.

The energy director 1122 may be part of the diffuser lens 1120 (e.g., the diffuser collar 1124), part of the reflector 1170 (e.g., the reflector collar 1172), or both. Further, more than one energy director 1122 may be used on one or more parts (e.g., diffuser 1120, reflector 1170). The dimensions (e.g., thickness, width, length) of the energy director 1122, as well as the location of the energy director 1122, may depend on one or more of a number of factors, including but not limited to the shape of the diffuser 1120 and/or reflector 1170, the material of the diffuser 1120 and/or reflector 1170, and cosmetic considerations.

The material of the energy director 1122 may be the same material as the diffuser 1120 and/or the reflector 1170. In one or more exemplary embodiments, the material of the energy director 1122, the diffuser 1120, and the reflector 1170 are substantially the same. The material of the energy director 1122, the diffuser 1120, and/or the reflector 1170 may be an amorphous polymer (e.g., polycarbonate, acrylonitrile butadiene styrene, polypropylene). The surfaces (e.g., the diffuser collar 1124, the reflector collar 1172) where the diffuser 1120 and the reflector 1170 mate using the energy director 1122 may be processed (e.g., smoothed, cleaned) in one or more ways prior to applying the energy to the energy director 1122.

Alternatively, or in addition to using an energy director 1122 in an ultrasonic weld, the diffuser 1120 and the reflector 1170 may be coupled using one or more other methods and/or mechanisms, including but not limited to double-sided tape, interference spheres/bumps, and epoxy. In certain example embodiments, the ultrasonic weld can be undone by a user without the use of tools. For example, the user may be able to apply a particular chemical or solution to the junction where the reflector collar 1172 is joined with the diffuser collar 1124 to easily separate the reflector 1170 from the diffuser 1120.

FIGS. 11A and 11B also show a different mounting feature 1176 than that shown in FIGS. 1-5 above. In this case, there are two identical mounting features 176, where each mounting feature includes a post 1177 that extends upward away from the top surface of the reflector 1170. Each post 1177 is secured on at least two sides by supports 1179 that are secured to the top outer surface of the reflector 1170. The posts 1177 can be mechanically coupled to a feature in the enclosure (not shown), including but not limited to clamps, clips, and fastening devices.

The systems, methods, and apparatuses described herein allow for LED-based lighting systems to be installed in new and/or exiting enclosures with little or no extra space. Specifically, example optical attachment features allow for the efficient adjustment, removal, and/or placement of one or more optical devices. Such optical devices can include, but are not limited to, a reflector, a lens, a diffuser, a hybrid lens, and a media. Further, example attachment mechanisms allow for simplified design of the enclosure, which reduces costs, saves time and material, and eases installation and maintenance.

Because the example optical attachment features are detachable from each other, the enclosure, and/or the trim, accessing optical features inside of the enclosure and/or trim is made simpler and requires no tools. These benefits save time and money, and increase the ease of maintenance and installation. In addition, changing optical features for decorative, optical, and/or aesthetic purposes becomes simple and time saving. Further, because certain example embodiments have the optical attachment features coupled to the enclosure and/or the trim, there is a greatly reduced chance of dropping, misplacing, or destroying the example optical attachment features.

Example embodiments of LED-based lighting systems described herein allow for relatively inexpensive modules that are easy to install. Further, example embodiments of LED-based lighting systems effectively reduce materials and parts required, as well as associated costs. Example embodiments of LED-based lighting systems also provide for aesthetically attractive fixtures that may be unique or that mimic an existing non-LED lighting system currently known in the art. In addition, example embodiments may be used in one or more of a number of types of installation for the lighting fixture, including but not limited to installations requiring torsion springs and installations requiring friction clips (and a corresponding friction clip mounting post).

Further, LED-based lighting systems allow for improved optical cutoff, reduced glare, and uniform illumination (i.e., no or minimal "dead zones," "cave effect," and/or light output fluctuations). Further, example embodiments of LED-based lighting systems allow for easier installation, maintenance, and disassembly. In addition, because of the use of LEDs, less energy may be consumed using example embodiments of LED-based lighting systems.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

We claim:

1. A light-emitting diode (LED) lighting system, comprising:

an enclosure comprising an enclosure wall forming a cavity and an enclosure collar having a first profile, wherein the first profile of the enclosure collar and the enclosure wall have a recess disposed therebetween;

a trim comprising a trim collar that directly abuts to the enclosure collar, wherein the trim collar has a second profile;

a reflector comprising an outer surface, an inner surface comprising a reflective material, and a reflector collar having a first optical attachment mechanism; and a diffuser comprising a diffuser collar, wherein the diffuser collar comprises a second optical attachment mechanism and a third optical attachment mechanism, wherein the second optical attachment mechanism couples to the first optical attachment mechanism, wherein the third optical attachment mechanism comprises a protrusion, and wherein the protrusion is disposed within the recess formed by the enclosure wall, the first profile of the enclosure collar, and the second profile of the trim collar when the enclosure collar is mechanically coupled to the trim collar.

2. The LED lighting system of claim 1, wherein the reflector further comprises at least one mounting receiver disposed on the outer surface of the reflector, wherein the enclosure further comprises a fastening device that removably couples to the at least one mounting receiver.

3. The LED lighting system of claim 2, wherein the fastening device is a threaded screw that traverses an aperture in the enclosure and threadably couples to the mounting receiver.

4. The LED lighting system of claim 1, wherein the reflector further comprises a third optical attachment mechanism disposed on the reflector collar, wherein the diffuser further comprises a fourth optical attachment mechanism disposed on the diffuser collar, wherein the third optical attachment mechanism is detachably coupled to the fourth optical attachment mechanism when the diffuser collar abuts the reflector collar.

5. The LED lighting system of claim 4, wherein the third optical attachment mechanism is a tab, and wherein the fourth optical attachment mechanism is a tab receiver.

6. The LED lighting system of claim 1, wherein the trim collar and the enclosure collar are mechanically coupled to each other using a fifth optical attachment mechanism.

7. A light-emitting diode (LED) lighting system, comprising:

an enclosure comprising an enclosure wall and an enclosure collar, wherein the enclosure collar comprises a first optical attachment mechanism, wherein the first optical attachment mechanism comprises at least one recess that transitions into at least one slot;

a reflector comprising an inner surface, an outer surface, and a reflector collar, wherein the inner surface comprises a reflective material, and wherein the reflector collar comprises a second optical attachment mechanism; and a diffuser comprising a diffuser collar having a third optical attachment mechanism and a fourth optical attachment mechanism, wherein the third optical attachment mechanism comprises at least one tab that directly couples to the first optical attachment mechanism of the enclosure, and wherein the fourth optical attachment mechanism directly couples to the second optical attachment mechanism of the reflector collar, wherein the first optical attachment mechanism couples to the third optical attachment mechanism when the at least one tab passes through the at least one recess and slides within the at least one slot by rotating the diffuser relative to the enclosure.

8. The LED lighting system of claim 7, wherein the reflector further comprises a fifth optical attachment mechanism disposed on the reflector collar, wherein the diffuser further comprises a sixth optical attachment mechanism disposed on the diffuser collar, wherein the fifth optical attachment mechanism is detachably coupled to the sixth optical attachment mechanism when the fourth optical attachment mechanism of the diffuser collar abuts the second optical attachment mechanism of the reflector collar.

9. The LED lighting system of claim 7, wherein the enclosure is a trim, and wherein the first optical attachment mechanism is a protrusion against which the third optical attachment mechanism abuts when the diffuser, the reflector, and the enclosure are coupled together.

10. The LED lighting system of claim 7, further comprising:

a trim comprising a trim collar that mechanically couples to the enclosure collar using an attachment mechanism.

11. The LED lighting system of claim 7, wherein the fourth optical attachment mechanism comprises an energy director that fuses the fourth optical attachment mechanism to the second optical attachment mechanism when ultrasonic energy is applied to the fourth optical attachment.

12. A light-emitting diode (LED) lighting system, comprising:

an enclosure comprising an enclosure wall forming a cavity and an enclosure collar having a first optical attachment mechanism, wherein the first optical attachment mechanism comprises at least one recess and at least one slot adjacent to the at least one recess;

a reflective device comprising an inner surface, wherein the inner surface comprises a reflective material; and a holder ring coupled to the enclosure collar, wherein the holder ring comprises a receiving feature and a second optical attachment mechanism, wherein the receiving feature is configured to detachably receive the reflective device, wherein the second optical attachment mechanism comprises at least one tab, and wherein the second optical attachment mechanism detachably couples to the first optical attachment mechanism of the enclosure collar when the at least one tab passes through the at least one recess and slides within the at least one slot by rotating the holder ring relative to the enclosure.

13. The LED lighting system of claim 12, further comprising:

a diffuser positioned between the reflective device and the holder ring.

14. The LED lighting system of claim 12, wherein the reflective device can be replaced with a different reflective device.

15. The LED lighting system of claim 14, wherein the different reflective device comprises a third optical attachment mechanism that is substantially similar to the second optical attachment mechanism, wherein the different reflective device replaces the reflective device and the holder ring when the different reflective device couples to the enclosure.

16. The LED lighting system of claim 12, further comprising:

a trim comprising a trim collar, wherein the trim collar mechanically couples to the enclosure collar using a third optical attachment mechanism.

17. The LED lighting system of claim 16, wherein the holder ring can be decoupled from the enclosure collar while the trim is mechanically coupled to the enclosure collar.

18. The LED lighting system of claim 7, wherein the third optical attachment mechanism of the diffuser maintains a coupled position with the first optical attachment mechanism of the enclosure using a friction fit.

19. The LED lighting system of claim 12, wherein the second optical attachment mechanism of the holder ring maintains a coupled position with the first optical attachment mechanism of the enclosure using a friction fit.

20. The LED lighting system of claim 12, wherein the holder ring further comprises at least one alignment feature disposed adjacent to the receiving feature, wherein the at least one alignment feature aligns and secures the reflective device when the holder ring is coupled to the enclosure.

* * * * *